United States Patent [19]

Kristiansen et al.

[11] 4,446,804

[45] May 8, 1984

[54] METHOD OF TRANSPORTING OIL AND GAS UNDER HIGH PRESSURE IN TANKS ON BOARD A SHIP

[75] Inventors: Olaf Kristiansen, Moss; Bo Brännstrøm, Høvik, both of Norway

[73] Assignees: Moss Rosenberg Verft A/S, Moss; Saga Petroleum a.s. & Co., Sandvika, both of Norway

[21] Appl. No.: 355,592

[22] PCT Filed: Jul. 8, 1981

[86] PCT No.: PCT/NO81/00031

§ 371 Date: Feb. 16, 1982

§ 102(e) Date: Feb. 16, 1982

[87] PCT Pub. No.: WO82/00186

PCT Pub. Date: Jan. 21, 1982

[30] Foreign Application Priority Data

Jul. 8, 1980 [NO] Norway ..... 802054

[51] Int. Cl.[3] ..... B63B 25/14

[52] U.S. Cl. ..... 114/74 R; 137/256; 137/263; 137/571

[58] Field of Search ..... 114/74 R; 414/140; 406/47, 48; 222/395; 137/1, 256, 263, 571, 590

[56] References Cited

U.S. PATENT DOCUMENTS

| | | | |
|---|---|---|---|
| 762,601 | 6/1904 | Smithson | 222/395 |
| 3,293,011 | 12/1966 | Lewis et al. | 48/190 |
| 3,307,512 | 3/1967 | Fell . | |
| 3,544,289 | 12/1970 | Berlin . | |
| 3,785,389 | 1/1974 | Friedland et al. | 137/1 |
| 3,830,180 | 8/1974 | Bolton . | |
| 3,831,811 | 8/1974 | Becker . | |

FOREIGN PATENT DOCUMENTS

| | | |
|---|---|---|
| 870508 | 2/1953 | Fed. Rep. of Germany . |
| 1577030 | 1/1969 | France . |
| 132442 | 2/1973 | Norway . |
| 305459 | 1/1968 | Sweden . |
| 315521 | 1/1968 | Sweden . |

*Primary Examiner*—Trygve M. Blix
*Assistant Examiner*—Rodney Corl
*Attorney, Agent, or Firm*—Browdy and Neimark

[57] ABSTRACT

The transportation of oil and gas under high pressure in tanks on board a ship is carried out by loading and unloading the oil/gas utilizing a suitable pressurized liquid, for example water, in the individual tanks, whereby during loading, a tank or a group of tanks containing pressurized liquid are filled with oil and gas while the pressurized liquid simultaneously is displaced into the next tank or group of tanks which are to be filled, after which the said next tank/group of tanks are filled and the pressurized liquid displaced into a third tank/group of tanks, etc., and that during unloading, the cargo in one tank or one group of tanks is removed by introducing a pressurized liquid into the tank/group of tanks, and unloading of the cargo in the next tank/-group of tanks occurs by transferring the pressurized liquid from the said first tank/group of tanks to the next.

3 Claims, 14 Drawing Figures

METHOD OF TRANSPORTING OIL AND GAS UNDER HIGH PRESSURE IN TANKS ON BOARD A SHIP

BACKGROUND OF THE INVENTION

The invention relates to a method of transporting oil and gas under high pressure in tanks on board a ship. The invention has been especially developed in connection with the utilization of so-called marginal fields in the North Sea. An economical utilization of the gas from finds in the North Sea requires that the gas must be recovered and transported to the consumer by means of a system which does not push the price up too high. The immediate solution that comes to mind is transportation in pipelines, but physical limitations such as the Norwegian channel, insufficiant quantity, etc. present hindrance in this regard. One should therefore have other alternatives in view, especially such as may be utilized in connection with smaller finds.

The extent to which an offshore gas and/or oil field can be utilized is among other things dependent on the economics of the recovery and transportation system one selects, and the size of the field, i.e., the quantity of the oil and gas which can be recovered, represents an important parameter. For smaller fields, the situation may be that if one is unable to find an especially simple and inexpensive system of transportation, it may not be feasible to utilize the field. Our deliberations indicate that storage and transportation of oil/gas under high pressure would represent a favourable solution. Such a solution, in brief, involves taking the entire flow from one or more oil wells on board ship in high pressure tanks and bringing it to land, where the necessary treatment, relief of pressure and separation occur. The land-based plant can serve several fields. Offshore, the field equipment can be limited to that which is necessary for connection in order to transfer the oil/gas to a tanker. However, the equipment on board the ship must be relatively advanced, especially the navigation equipment, if the system involves locating the well from the tanker. Alternatively, one can naturally utilize a loading buoy.

The invention concerns a method which is to be utilized in connection with the transportation of oil and gas under high pressure, and provides a solution to the problems one encounters in loading and unloading.

In accordance with the invention, it is proposed that loading and unloading be carried out utilizing a suitable liquid under pressure, e.g. water, in the individual tanks on board the ship, whereby during loading, a tank or a group of tanks containing pressurized liquid are filled with oil while the pressurized liquid simultaneously is displaced into the next tank or group of tanks to be filled, after which the said next tank/group of tanks are filled with cargo while the pressurized liquid becomes displaced into a third tank/group of tanks, etc, and that during unloading, the cargo from one tank or one group of tanks is removed by introducing a pressurized liquid into the tank/group of tanks, unloading of the cargo in the next tank/group of tanks occuring through the transfer of the pressurized liquid from the said first tank/group of tanks into the next, etc.

The method of the invention can be used both in connection with oil and associated gas and for gas alone. The pressure in an oil/gas well will usually (at least for a certain period of time) be much higher than 100 bar. It is assumed, however, that the most economical solution will be obtained if the pressure, by relieving the pressure through expansion of volume, can be reduced to around 100 bar.

With the invention one eliminates the drawbacks associated with pressurized filling of empty tanks, and it also permits unloading to be performed in a simple manner.

If the cargo is introduced into a non-pressurized tank, an initial pressure drop of about 100 bar over the control valve will result, and this has the following unfavourable consequences:

Firstly, much of the liquid will evaporate (flash gas) and the volume of the tank will be poorly utilized; secondly, the evaporation consumes heat, which causes a drop in temperature and freezing of the water accompanying the liquid; and thirdly, with the big drop in pressure, one will obtain high velocity flow (speed of sound) through the control valves, and sand particles accompanying the oil will thus cause much wear on the fittings and piping. The high flow speed will also produce cavitation and noise problems.

To prevent the above, one might use gas as the pressure medium, i.e., building up the gas pressure in the tanks to about 100 bar by means of compressors prior to loading, and forcing the cargo by pressure onto land by means of the same compressors. However, this would require great amounts of energy and is unfavourable from the point of view of safety as compared to pumping water. Relatively little energy is required to increase the pressure in a water-filled tank from 0 to 100 bar.

The loading and unloading rate is controlled by regulating and controlling the amount of water which is removed from or introduced into the tanks, respectively. The above-mentioned flow control problems will not be experienced, even at great drops in pressure.

During loading, the drive pressure is supplied "gratis" from the oil/gas wells, and in unloading, the drive pressure is maintained by water pumps.

The invention will be elucidated in greater detail in the following with reference to the accompanying drawings, wherein

DETAILED DESCRIPTION OF THE INVENTION

Figure 1:
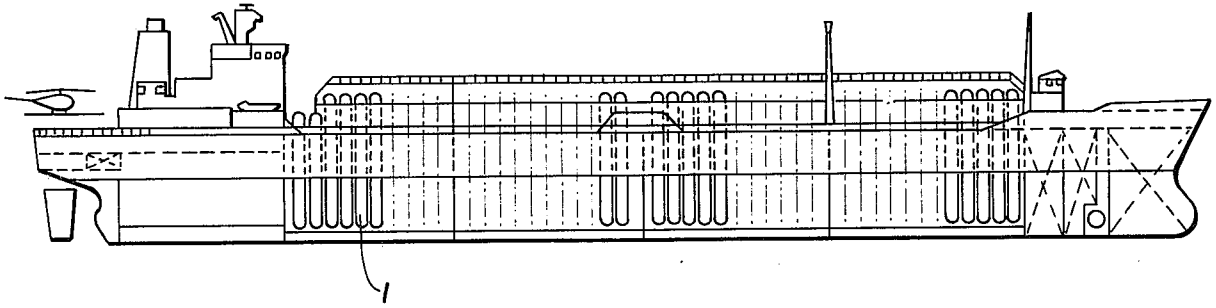
FIGS. 1, 2 and 3 show a tanker suitable for the high pressure transportation of oil and gas, in side view, cross section and plan view, respectively.
Figure 2:
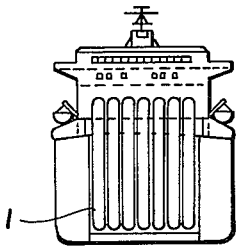
Figure 3:
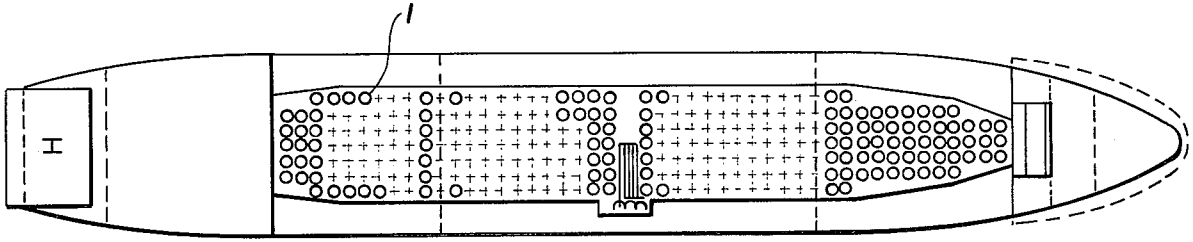

The tanker shown in FIGS. 1, 2 and 3 is provided with a large number of separate tanks arranged in groups, with a specified number of tanks in each group. The tanks 1 are formed as upstanding, relatively slim cylindrical tanks. For example, the tank diameter can be 2 m, while the height of the tank is 22.5 m. The volume of such a tank will be about 80 $m^3$. 100 bar is calculated to be the working pressure.

All of the tanks in one group are loaded/unloaded in parallell. There are two sets of main conduits (not shown), such that one group on the starboard side and one group on the port side can be loaded/unloaded simultaneously. Rather than in the manner illustrated, the tanks could also be arranged horizontally and then be of a length approximately corresponding to the length between the forward and after cofferdams.

Figure 4:
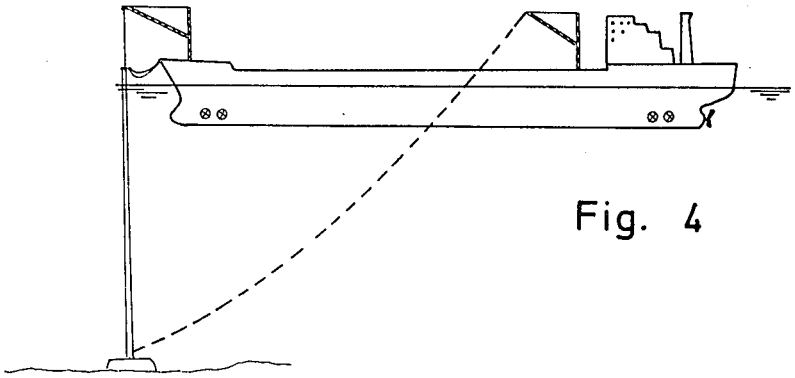
FIG. 4 shows a tanker connected to an offshore installation on the sea bed.
Figure 5:
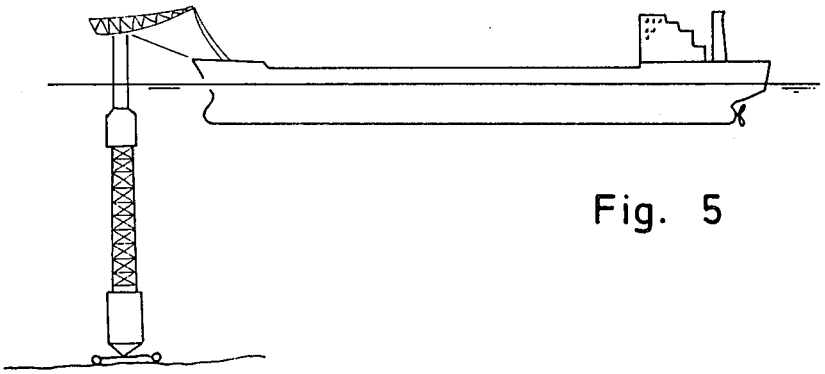
FIG. 5 shows a tanker connected to a derrick buoy.

FIG. 4 shows how the tanker can be coupled to a recovery installation located on the sea bed, and FIG. 5 shows how the tanker can be moored to and connected for loading of oil/gas at a derrick buoy.

Figure 6:
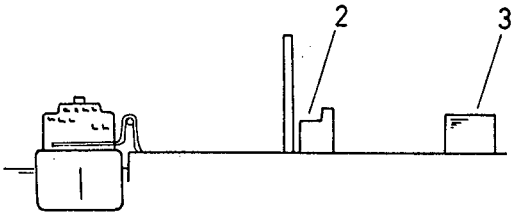
FIG. 6 shows the tanker at the land installation, FIGS *7a–g* are flow diagrams for the tank installation on board the tanker, illustrating the respective conditions under ballast and during loading and unloading.

In FIG. 6, the tanker is shown at a land installation.

Of the equipment required offshore, a collecting system in a loading buoy or the like, and also water injection equipment, should be mentioned. The land installation is a conventional type and contains a treatment plant 2 and a storage installation 3.

The advantages of high pressure loading/unloading are obvious. Oil/gas can be taken directly from the well(s), and when the tanker is not actually on location at the loading site, the recovery installation can be "put to rest". It can optionally be totally unmanned in these periods, or have only a minimal maintenance crew in attendance, for example. The water injection equipment may for instance be arranged on board the tanker. The total economy for such recovery of oil/gas is therefore very favourable.

Figure 7A:
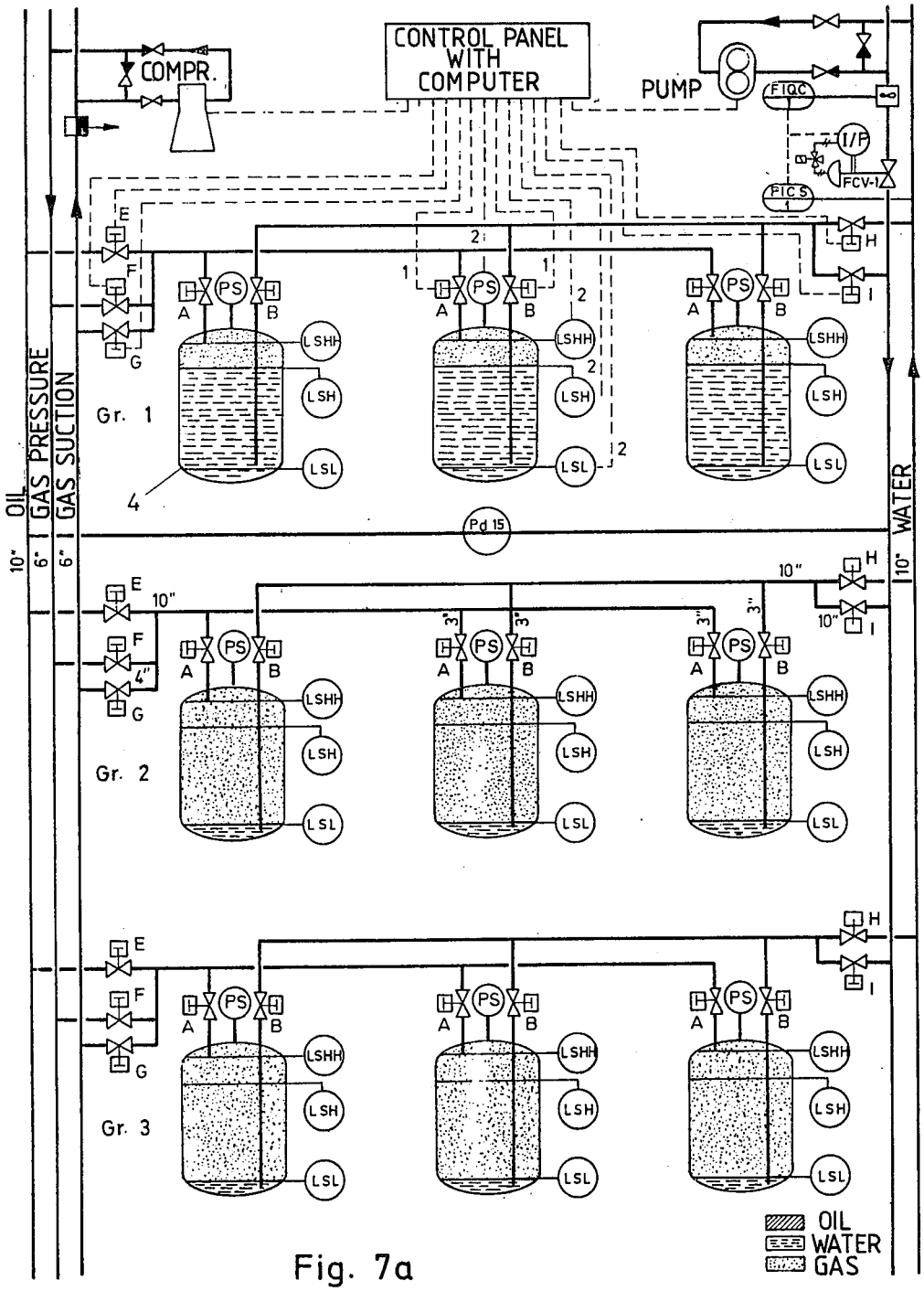

With reference to FIG. 7*a*, the most important equipment and the most important components in the flow diagram will be defined. The installation is for a high pressure carrier having, e.g., 280 tanks, where the diameter of each tank is 2 m and the height of the tank, 22.5 m. Each tank thus has a volume of 70 $m^3$. The total volume will be 19.600 $m^3$. The calculated working pressure is 100 bar. The loading/unloading time is calculated to be about 16 hours, and per tank/group of tanks a loading/unloading time of 1 hour and 10 minutes is calculated. The tanks are arranged in groups, with ten tanks in each group, or 28 groups of tanks. In the flow diagram, only three of the ten tanks in each group are illustrated. All of the tanks in one group are loaded/unloaded in parallel. Two sets of main conduits are provided such that one group on the starboard side and one group on the port side can be loaded/unloaded simultaneously. The flow diagram shows only one side, for instance the starboard side. The total loading/unloading capacity is about 1200 $m^3$ hour.

There are the following main conduits with branch lines to each group:

loading/unloading conduit
gas pressure line
gas suction line
water supply conduit
water discharge conduit
safety valve conduit i.e., 12 main lines along the ship, exclusive of various auxiliary systems.

Each tank 4 is provided with three level sensors, LSL, LSH and LSHH. These sensors can register oil, water and gas. The most important valves are designated A, B, E, F, G, H and I, respectively. Necessary control apparatus is provided for the valves, which will be well known to the skilled person.

Each tank has two safety valves with a set point of 105 bar, and a pressure switch RS with a somewhat lower set point for alarm and automatic closure.

A flow control valve is designated FCV-1. This valve controls the loading and unloading and is dimensioned for 700 $m^3$ per hour. The closure pressure is 110 bar. The valve is provided with positions and is controlled in split range by the flow instrument FIQC-1 and the pressure regulator PIC-1.

FIG. 7*a* shows the conditions on a ballast voyage. All tanks are non-pressurized and filled with gas, with the exception of the tanks in group 1, which are filled with water up to a level which is sensed by the sensor LSH.

Figure 7B:
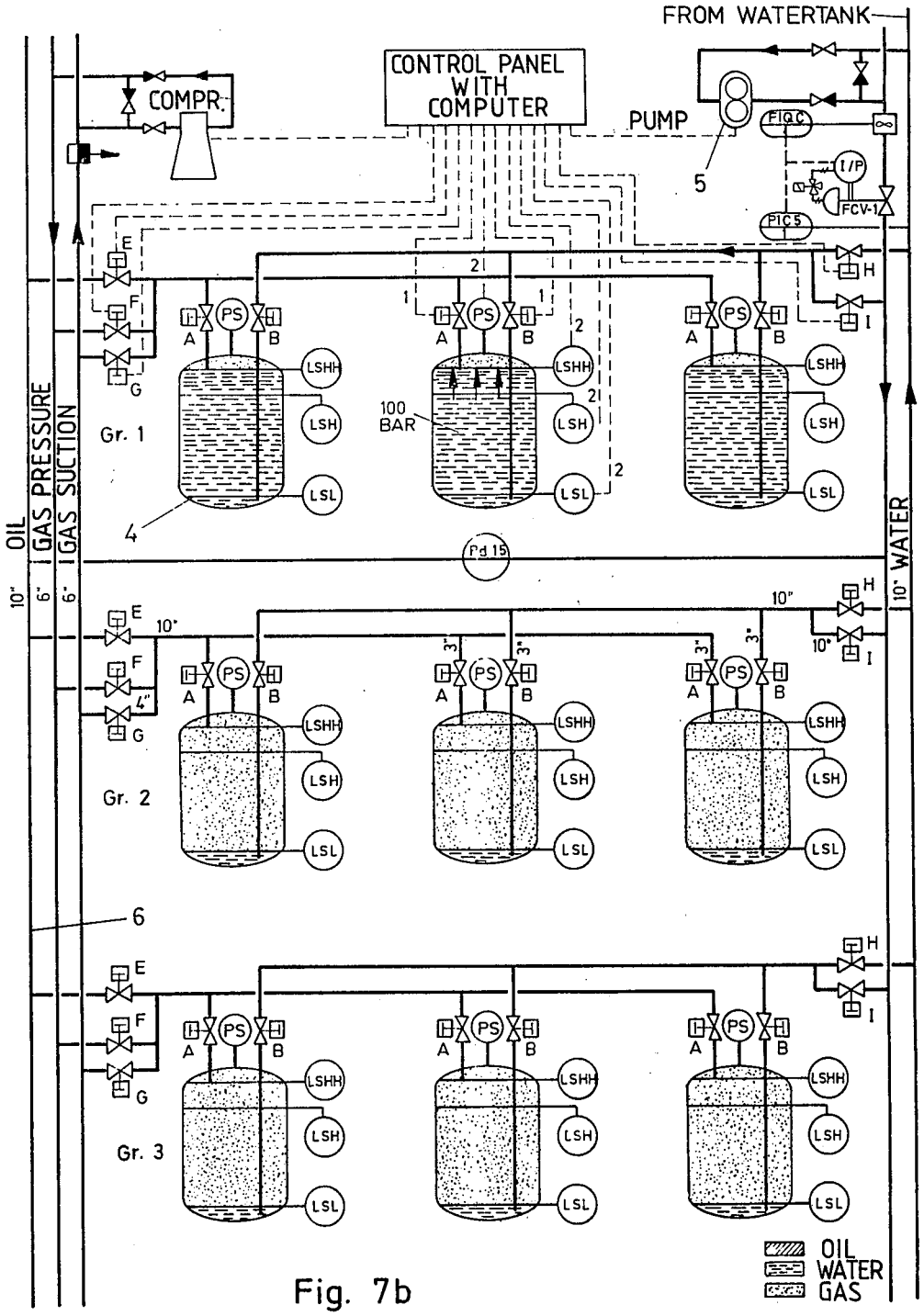

Before loading begins, the pressure is increased (FIG. 7*b*) in tank group 1 by opening valves A–B and I for this group, and the water pump 5 is started. The pump suctions water from a not-illustrated water tank (indicated at the upper right-hand corner of FIG. 7*b* by the words "from water tank"), and the level in the tanks 4 rises while the pillow of gas therein becomes compressed. This can be done at the same time as the oil pressure is built up in the main conduit 6.

Figure 7C:
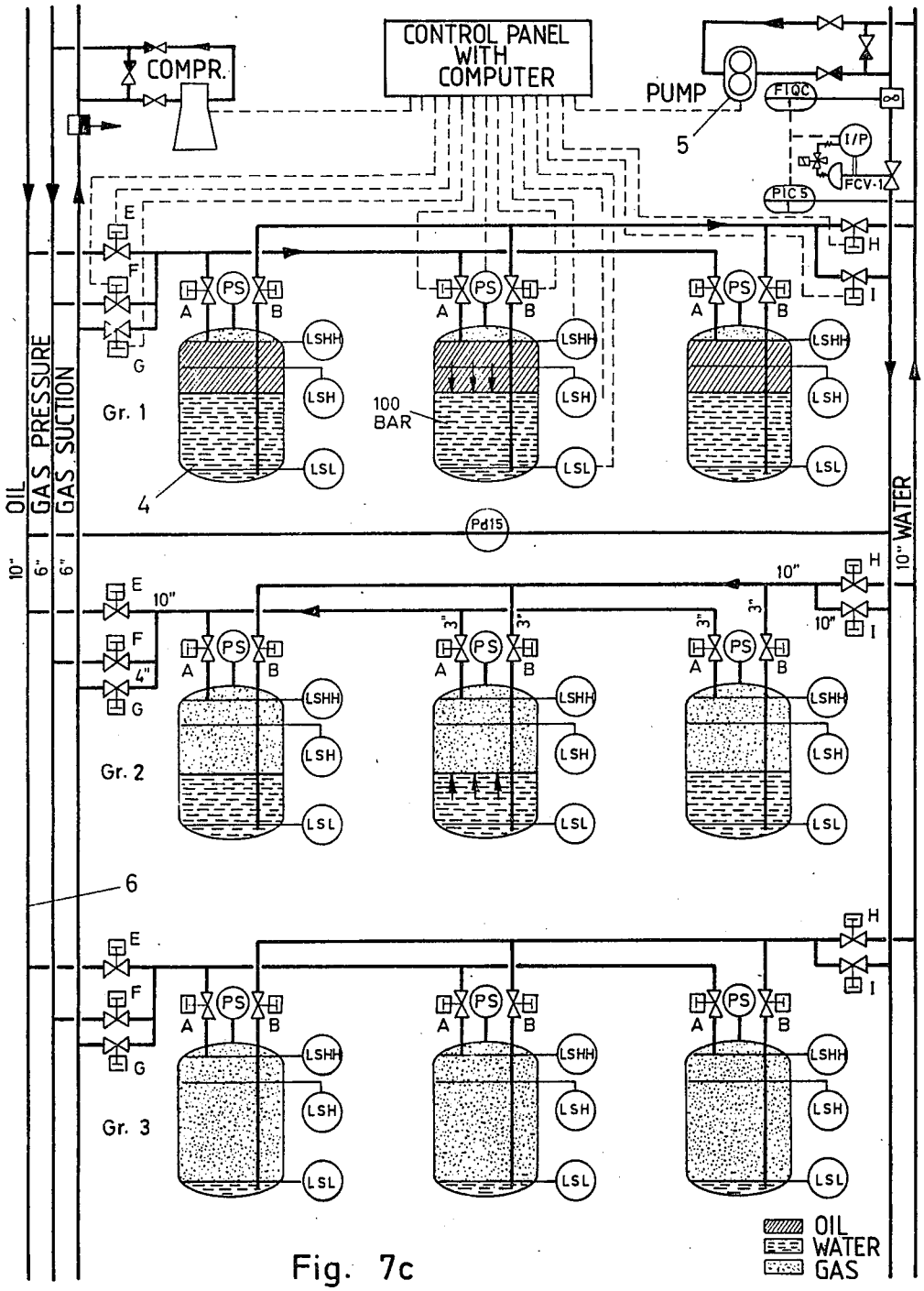

When the water pressure in tank group 1 is equal to the pressure in the main conduit 6 for oil, i.e., about 100 bar, and the selector switch at the control panel has been set on "Loading Auto", the following will occur, preferably automatically by means of instrument and a computer system (FIG. 7*c*). The computer system, in principle a microprocessor, has the possibility of rapid re-programming for different loading/unloading procedures, adapted to varying parameters in regard to time, composition, pressure etc. The pump 5 stops and the valves E and H for group 1 open. Valves A-B-G and I in group 2 also open. The valve I for group 1 is closed. The tanks in group 1 are now under pressure from the main conduit 6 and the pressure reaches the flow control valve FCV-1.

The flow control valve FCV-1 is controlled primarily by the quantity monitor FIQC-1, and the set point for the latter is now regulated gradually from 0 to the desired loading capacity, for example 600 $m^3$ per hour, and loading is underway. If the pressure falls such that there is a risk that the oil might give off gas (for example at 95 bar), the pressure regulator PIC-1 takes over the control of the flow control valve FCV-1 such that a constant counterpressure is maintained.

When the loading of tank group 1 on the starboard side has gone on for about ½ hour, loading of tank group 1 on the port side commences.

As the water level in tank group 2 reaches the level sensed by the sensor LSH, this sensor will send a signal to close the valves A. When all have been closed, valve G closes and the valves A reassume an open position. The pressure in tank group 2 begins to increase, the water level rises and the gas becomes compressed. The pressure drop over the flow control valve FCV-1 is reduced and the regulating valve gradually assumes a fully open position.

When the sensor LSL in tank group 1 signals "oil", valves A and B are closed, and when all are closed, valves E and H also close. Tank group 1 is finished loading and the pressure in tank group 2 will now be about 100 bar.

Figure 7D:
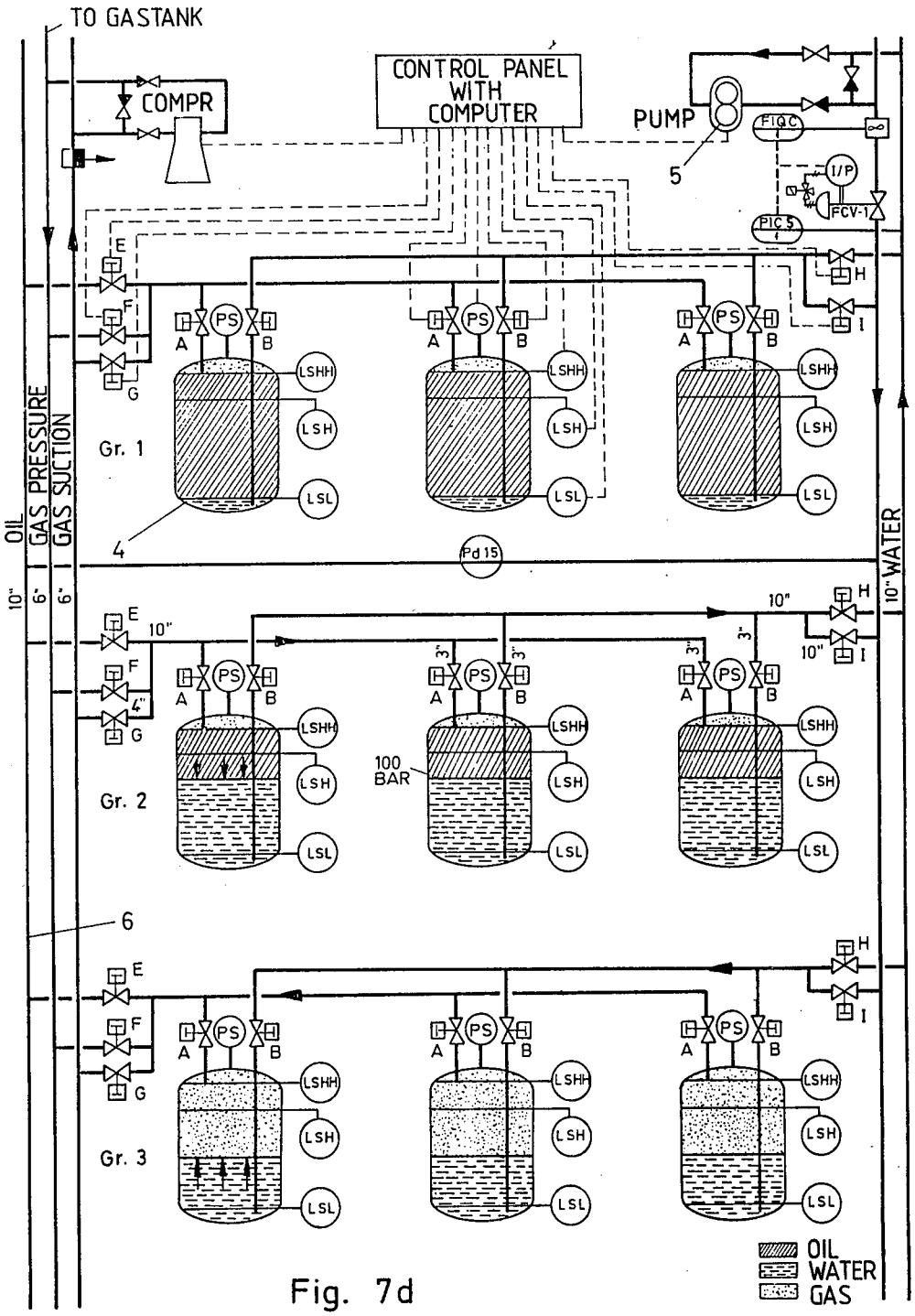
Figure 7E:
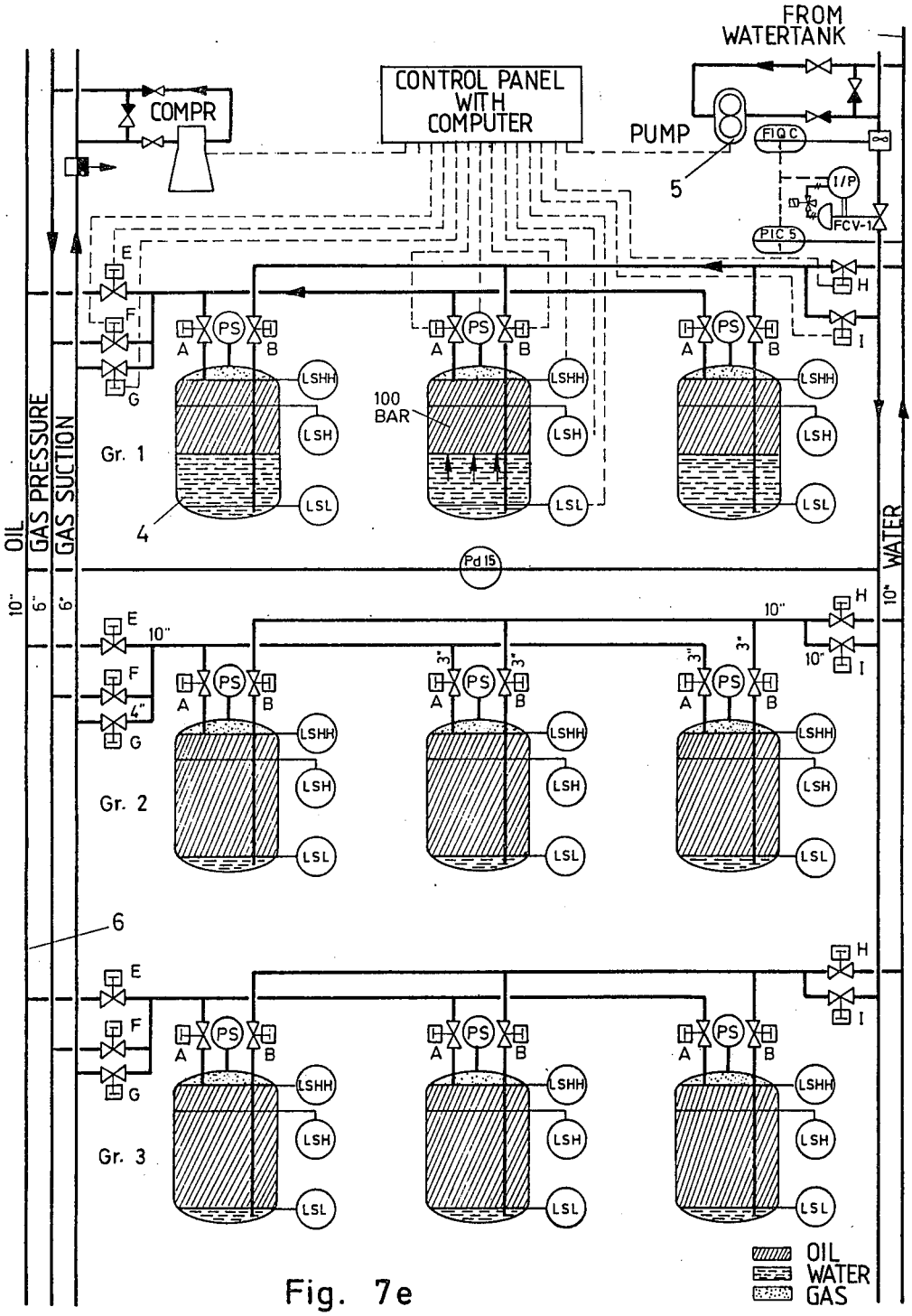
Figure 7F:
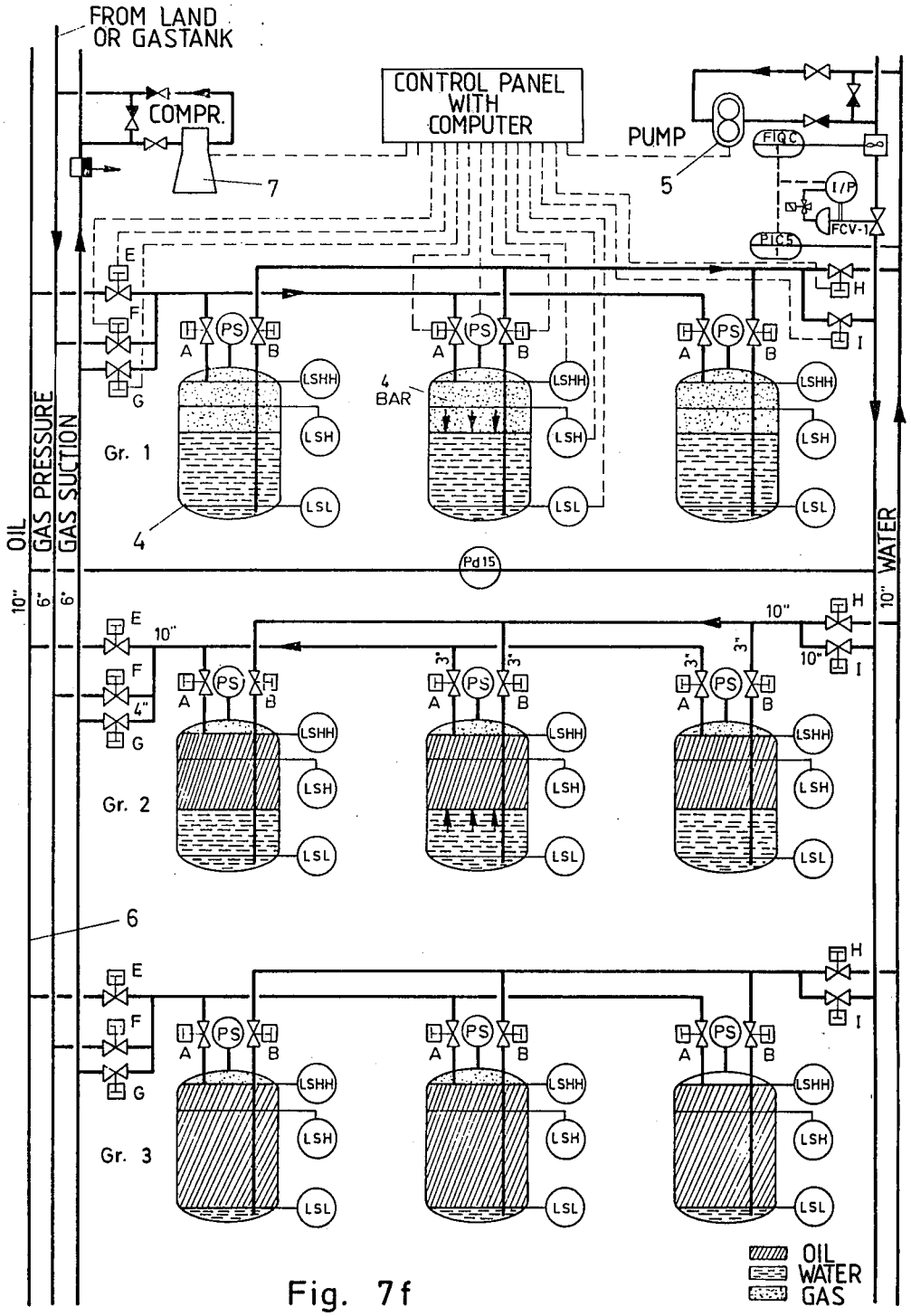
Figure 7G:
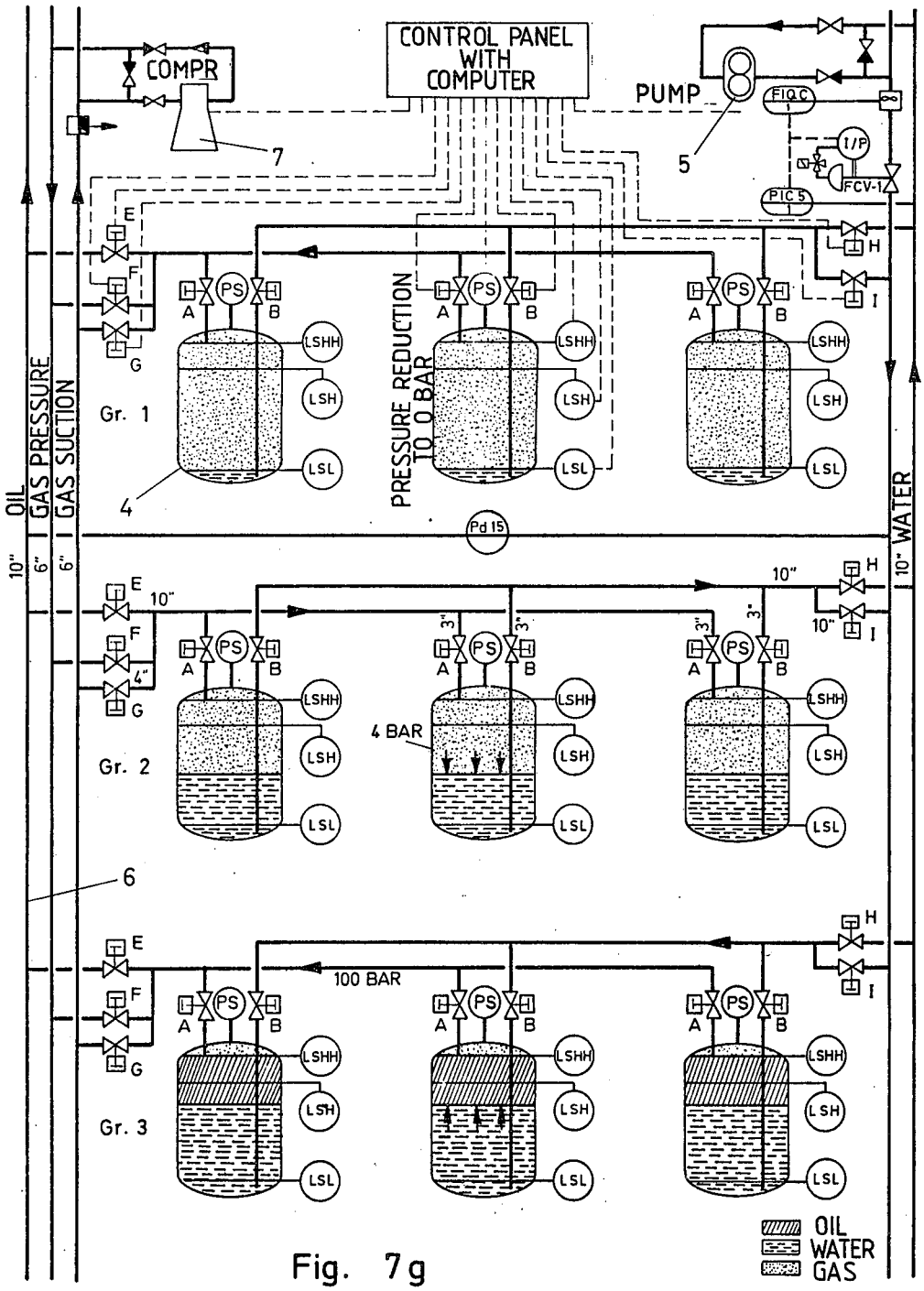

Loading continues as shown in FIG. 7*d*. At the same time as valves E and H for tank group 1 are closed, corresponding valves for tank group 2 are opened, as well as valves A-B-G and I for tank group 3; the filling of tank group 2 commences and the water is forced by pressure over into tank group 3, while the gas is pressed out and vented off at the mast or is compressed and stored in gas tanks.

If the pressure difference between the main conduit 6 and a tank group is too great (for example, more than 5 bar), filling will not commence until the water pump 5 has built up the prewsure in the tanks. The water in the last group of tanks is forced by pressure over into a separate water tank (not illustrated).

FIG. *7e* illustrates the situation during unloading. Before commencing to unload, all the valves E and I are opened, and a counterpressure from land which is equal to the tank pressure is thus established in the main conduit 6. When this has been done, and a selector switch at the control panel has been set on "Unloading Auto", the following will occur: The pump 5 starts up and suctions water from the (not illustrated) water tank. When the pressure in the water conduit is equal to the pressure in the tanks, the valves A and B in tank group 1 are opened and unloading is underway. The set point for the quantity monitor FIQC-1 is gradually increased to the desired unloading capacity, for example, 700 $m^3$ per hour for ten tanks.

The necessary counterpressure to prevent flashing in the system is controlled on land.

Figure 8:
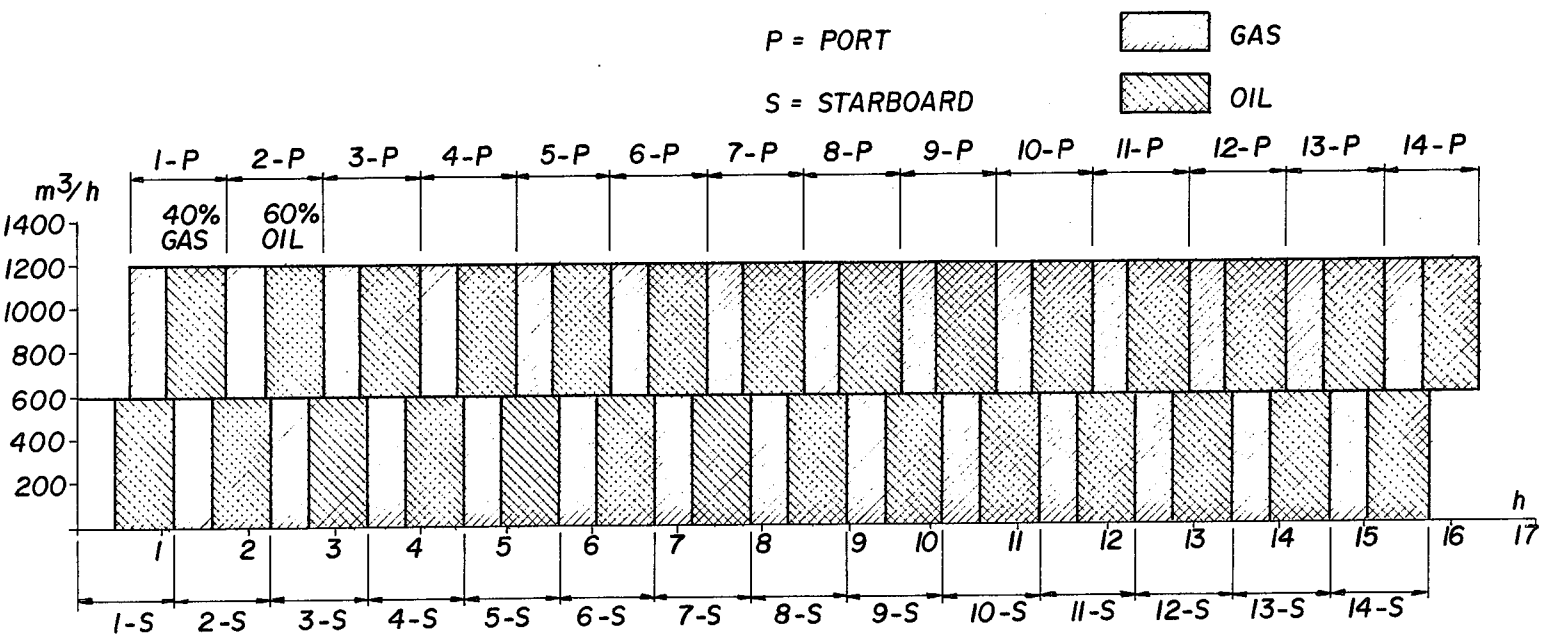
FIG. 8 is a schematic diagram illustrating the phasing in of the unloading of gas so as to hold the oil/gas mixture ratio as constant as possible during the entire unloading operation.

When the unloading of tank group 1 on the starboard side has proceeded for about ½ hour, unloading of tank group 1 on the port side is started. In this way, the gas from one tank group is always unloaded simultaneously with the oil from another group, which gives the advantage that the gas/oil flow to the land installation will be of an approximately constant composition for the duration of the unloading period, except at the start/stop of the unloading (FIG. 8).

When the level sensor LSHH indicates "water", the valves A are closed, and when all of these are closed, the valves E and I for tank group 1 also close.

The ensuing situation during unloading is shown in FIG. *7f*. The valve H in tank group 1 and valves A and B in tank group 2 open. The pump 5 will now suction water from tank group 1 and press oil out of tank group 2, and the unloading is still controlled by the flow control valve FCV-1.

When the pressure in tank group 1 has fallen to below 4 bar, the valves A and F are opened and gas from the gas tanks (not illustrated) is allowed access in order to force the water up to the suction side of the pump, while at the same time the oil line for group 1 is blown empty.

When the level sensor LSL in tank group 1 indicated "gas", valves B are closed, and when all are closed, valves H and F also close. Gradually, as the tanks in tank group 2 become empty of oil, i.e., when the level sensor LSHH signals "water", valves A are closed, and when all are closed, valves E and I also close.

The terminating unloading operation is shown in FIG. *7f*. When all the water has been pumped from tank group 1 and over into tank group 2, the water is automatically pumped further to tank group 2 and the oil is forced by pressure to the land.

When the pressure in tank group 2 has fallen to below 4 bar, the valves A and G in tank group 1 are opened, as well as the valves A and F in tank group 2, and the compressor 7 starts. The pressure is thereby lowered in tank group 1 and is maintained in tank group 2 to raise the water up to the pump 5. At the same time, the oil conduit to tank group 2 is blown empty of oil. When the pressure in tank group 1 has fallen to zero, the valves A and G are closed. In this manner, there will be atmospheric pressure in the tanks 4 when unloading is finished.

"Additional Gas" for refilling the tanks 4 during unloading is taken from land or from special pressurized tanks on board the carrier.

We claim:

1. A method of transporting oil and gas under high pressure in tanks on board a ship, wherein loading and unloading are carried out utilizing a suitable liquid under pressure, for example water, in the individual tanks, said loading comprising filling a tank or group of tanks containing pressurized liquid with oil and gas while the pressurized liquid simultaneously becomes displaced into a next tank or group of tanks which are to be filled, after which the said next tank/group of tanks are filled with cargo while the pressurized liquid becomes displaced into a third tank/group of tanks, etc., and said unloading comprises removing the cargo from one tank or one group of tanks by introducing a pressurized liquid into the tank/group of tanks, the unloading of the cargo in the next tank/group of tanks occurring through the transfer of the pressurized liquid from the said first tank/group of tanks to the next, etc.

the ratio of the oil/gas mixture being held as constant as possible throughout the entire unloading operation by phasing in the unloading of gas from the various tanks or groups of tanks.

2. The method of claim 1 wherein the steps of loading and unloading further include detecting signals from sensors located at said tank or group of tanks, and automatically controlling movement of said cargo based on said signals.

3. A method of transporting oil and gas under high pressure in tanks on board a ship, wherein loading and unloading are carried out utilizing a suitable liquid under pressure, for example water, in the individual tanks, said loading comprising filling a tank or group of tanks containing pressurized liquid with oil and gas while the pressurized liquid simultaneously becomes displaced into a next tank or group of tanks which are to be filled, after which the pressurized liquid becomes displaced into a third tank/group of tanks, etc., and said unloading comprises removing the cargo from one tank or one group of tanks by introducing a pressurized liquid into the tank/group of tanks, the unloading of the cargo in the next tank/group of tanks occurring through the transfer of the pressurized liquid from the said first tank/group of tanks to the next, etc., the ratio of the oil/gas mixture being held as constant as possible throughout the entire unloading operation by phasing in the unloading of gas from the various tanks or groups of tanks, and automatically controlling said loading and unloading.

* * * * *